United States Patent [19]

Lang

[11] 4,091,895

[45] May 30, 1978

[54] OIL LEVEL SENSING APPARATUS

[75] Inventor: James R. Lang, Littleton, Colo.

[73] Assignee: The Mechanex Corporation, Englewood, Colo.

[21] Appl. No.: 775,765

[22] Filed: Mar. 9, 1977

[51] Int. Cl.[2] ..... F01M 11/12

[52] U.S. Cl. ..... 184/103 R; 184/105 R

[58] Field of Search ..... 184/103 R, 103 A, 105 R, 184/84; 123/132; 222/64, 65, 69

[56] References Cited

U.S. PATENT DOCUMENTS

| | | | |
|---|---|---|---|
| 1,317,961 | 10/1919 | Conwell | 184/103 R |
| 1,328,843 | 1/1920 | Martin | 184/103 R |
| 1,340,687 | 5/1920 | Schell | 184/103 A |
| 1,705,845 | 3/1929 | Woodman | 184/103 R |
| 2,081,315 | 5/1937 | Weber | 184/103 R |
| 3,712,420 | 1/1973 | Pelizzoni et al. | 184/105 R X |
| 3,777,852 | 12/1973 | Samolon et al. | 184/105 R X |

*Primary Examiner*—David H. Brown

*Attorney, Agent, or Firm*—Thomas E. Torphy; James R. Hagen

[57] ABSTRACT

A standpipe type sensing apparatus for a barometric or gravity induced flow oil level regulator for maintaining oil in an engine crankcase at a desired level has a vent which places an air space in the standpipe in fluid flow communication with a relatively oil free portion of a relatively calm air space above the oil level in the crankcase. The vent assures that the air pressure in the standpipe air space and in the crankcase air space are substantially equal during operation of the engine. A fluid flow damping orifice is provided to retard the rate of fill and drainage of oil from a sensing chamber in the standpipe. The standpipe apparatus is readily installed onto engines without the need to remove the oil pan.

8 Claims, 5 Drawing Figures

OIL LEVEL SENSING APPARATUS

BACKGROUND OF THE INVENTION

Barometric or gravity induced flow oil level regulators have long been used to maintain oil in an engine crankcase at a desired predetermined level. In these systems an air tight oil reservoir is mounted at a level above the desired oil level in the crankcase and the reservoir is connected in fluid flow communication with the crankcase by an oil carrying conduit connected to a low point in the reservoir and an air carrying conduit connected to an air space above the oil level in the reservoir. In some cases, the same conduit carries both the oil and the air.

In a standpipe system the air and oil carrying conduit or conduits are connected to a sensing chamber outside the crankcase and the sensing chamber is in fluid flow communication with the crankcase. A portion of the standpipe sensing chamber is positioned above the desired oil level in the crankcase so that an air space exists above the oil level in the standpipe sensing chamber.

The air carrying conduit has an open end maintained within the sensing chamber at the level at which it is desired to maintain oil within the crankcase. When the oil level is low in the crankcase and consequently in the sensing chamber, air travels through the open end of the air carrying conduit and up the conduit to the reservoir to relieve a partial vacuum in the air space above the oil in the reservoir. Consequently oil commences to flow from the reservoir to the crankcase via the oil supply conduit. The oil flows until the open end of the air carrying conduit is covered or sealed by oil so that air can no longer flow to the air space in the reservoir.

The oil continues to flow until the pressure differential between the air pressure in the reservoir and the air pressure in the air space above the oil in the crankcase equals the head of oil in the supply line, at which time flow ceases until air can again flow through the air carrying conduit.

In prior art standpipe systems the air space in the sensing chamber has usually been vented to atmosphere. Although the crankcase is also vented to atmosphere, during engine operation the air pressure above the oil in the crankcase may not be the same as the atmospheric pressure in the air space in the sensing chamber due to blockages in the crankcase venting, such as a partially blocked road draft tube or positive crankcase ventilation valve and/or conditions such as worn piston rings which allow large amounts of combusted air/fuel charge gases which drive the pistons to bypass the cylinder wall/piston ring interface and escape into the crankcase.

U.S. Pat. No. 1,340,687 shows an oil level regulator system in which an air space in a standpipe is connected in fluid flow communication with the crankcase. In this patent a conduit connects the sensing chamber air space directly to the crankcase to circulate oil from the crankcase to the sensing chamber. Due to the oil flow in this conduit as well as air turbulence and localized windages present within the crankcase caused by moving engine components this conduit would not provide a dependable pressure equalizing vent between the crankcase air space and the sensing chamber air space during operation of the engine.

SUMMARY OF THE INVENTION

A sensing chamber in a standpipe apparatus or device for a crankcase oil leve regulator has an air space within the sensing chamber vented to a substantially calm, oil free air containing, portion or space of the engine which is in fluid flow communication with an air space above the oil in the crankcase to assure that the air pressure in the sensing chamber air space is substantially equal to the air pressure in the crankcase air space at all times. A liquid flow rate retarding or damping orifice is provided in the sensing chamber of the standpipe to reduce the rate of liquid flow to and from the sensing chamber. The orifice is positioned so that it does not impede the flow of oil from the regulator reservoir to the crankcase.

DETAILED DESCRIPTION OF THE INVENTION

Figure 1:
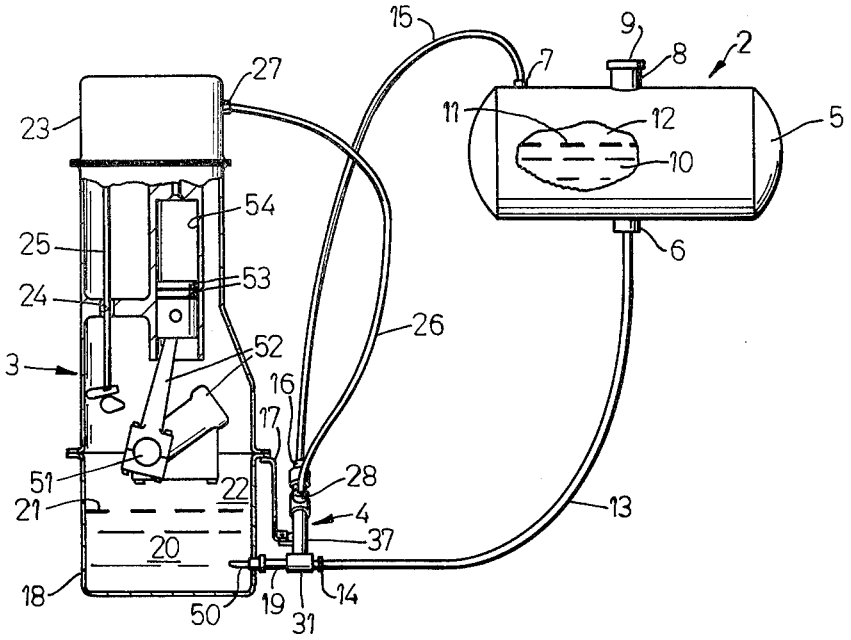
FIG. 1 shows a schematic view of a representative engine and crankcase oil level regulator system having the standpipe apparatus of this invention.

Referring to FIG. 1 a typical air tight oil level regulator reservoir 2 is shown connected to a representative engine 3 via a standpipe apparatus 4. Reservoir 2 is comprised of a tank 5 having near its lower portion an oil outlet fitting 6 and near its top an air inlet fitting 7 and an oil replenishment inlet 8 which is normally sealed by a removable cap 9. Referring to the cutaway wall portion of tank 5 the reservoir normally contains a quantity or pool of oil 10 having a surface 11 above which exists an air space 12.

Reservoir 2 is connected to standpipe apparatus 4 by an oil supply means, such as conduit 13, which is sealingly connected in fluid flow communication with an oil flow portion of apparatus 4 by appropriate connective means 14. An air carrying means, such as conduit 15, places air space 12 of reservoir 2 in fluid flow communication with a sensing chamber in standpipe apparatus 4 by appropriate connective means 16.

Standpipe apparatus 4 is mounted in a substantially rigid position on engine 3 by appropriate means, such as bracket 17, and an oil flow portion of apparatus 4 is placed in fluid flow communication with engine crankcase 18 by appropriate conduit means 19. Crankcase 18 normally contains a pool of oil which fills the crankcase to a desired level, such as 21. Above the oil pool 20 an air containing space 22, hereinafter referred to as an air space, is present in the engine. In normal engine construction air space 22 is in fluid flow communication with various portions of the engine remote from the crankcase. For example, in the representative engine 3 air space 22 is in fluid flow communication with an air space defined by valve rocker arm cover 23 via fluid flow areas between space 22 and the space defined by the internal surfaces of cover 23, such as the clearance 24 adjacent push rod 25.

A vent means, such as air carrying conduit 26, places air space 22 above oil pool 20 in fluid flow communication with apparatus 4 via a relatively calm, substantially oil free air space remote from oil pool 20, such as the air space present within cover 23. A first end 27 of conduit 26 is sealingly engaged with cover 23 to place the air space within cover 23 in fluid flow communication with an air space in a sensing chamber in apparatus 4 to provide an equal air pressure in each air space 22 and the air space in apparatus 4.

In air space 22 a veritable oil laden hurricane is present during operation of the engine. Violent air currents caused by rapidly moving components and blowby gases impel oil droplets and spray throughout air space 22 and violently agitate and distort the surface of oil pool 20. It is to be understood that any air space or air containing location within the engine which is relatively calm and substantially oil free compared to air space 22 will aid the function of the vent means. The air space within cover 23 is particularly good because the fluid passages which place it in fluid flow communication with air space 22 dampen air pressure surges attempting to travel from space 22 to the space within cover 23. Also, though there are oil sprays present within cover 23 and some air turbulence due to rocker arm movement this space is relatively calm and substantially oil free compared to space 22.

Figure 2:
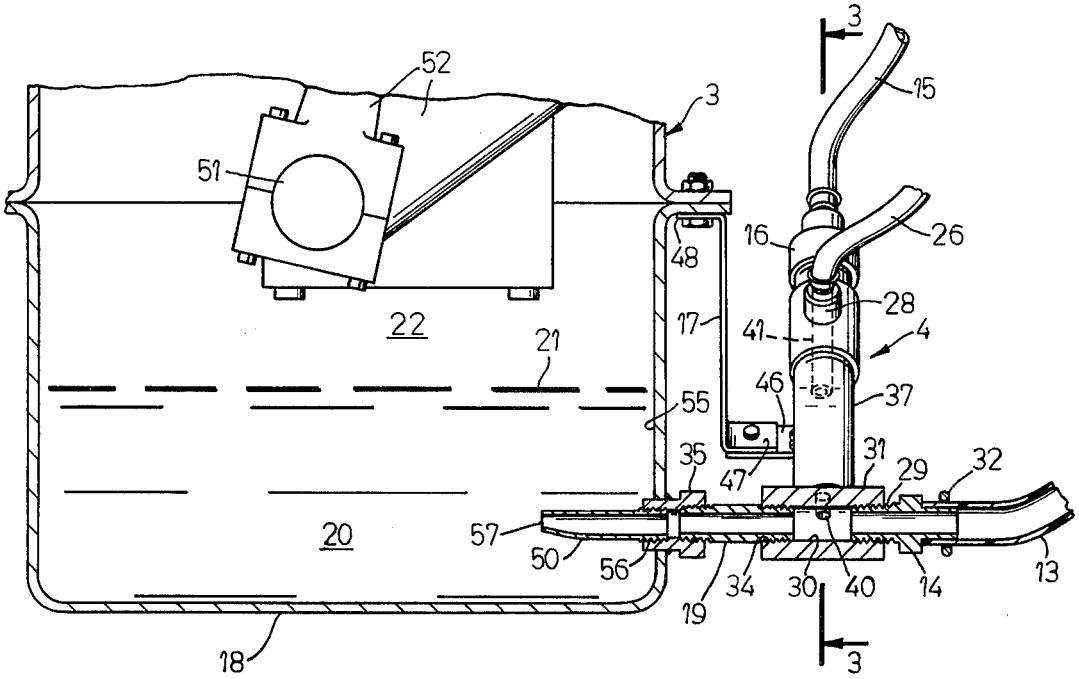
FIG. 2 shows an enlarged partial view of the standpipe apparatus shown in FIG. 1.

FIG. 2 shows apparatus 4 and crankcase 18 as shown in FIG. 1 in enlarged detail. As in FIG. 1, the pool of oil 20 fills crankcase 18 to a desired level 21 and an air space 22 is present above the oil pool. Air carrying conduit 15 is connected to an upper portion of apparatus 4 by appropriate connective means 16 and vent conduit 26 is shown connected to apparatus 4 by appropriate connective means 28.

Oil supply conduit 13 is sealingly engaged in fluid flow communication with a first end 29 of an oil flow passage 30 located within a base member 31 of apparatus 4 by connective means 14. As shown, connective means 14 is comprised of a threaded fitting having a tube receiving nipple on one end and conduit 13, a resilient tube, is placed over the nipple and sealingly engaged with it by a clamp 32. A connective means, such as threaded conduit 19 is sealingly engaged with a second end 34 of flow passage or chamber 30 and is sealingly engaged with crankcase 18 by appropriate connective means, such as fittings 35, to place flow passage 30 in fluid flow communication with oil pool 20 whereby oil flowing from tank 5 through conduit 13 flows through flow passage 30 into crankcase 18 at a point well below the desired oil level 21.

Figure 3:
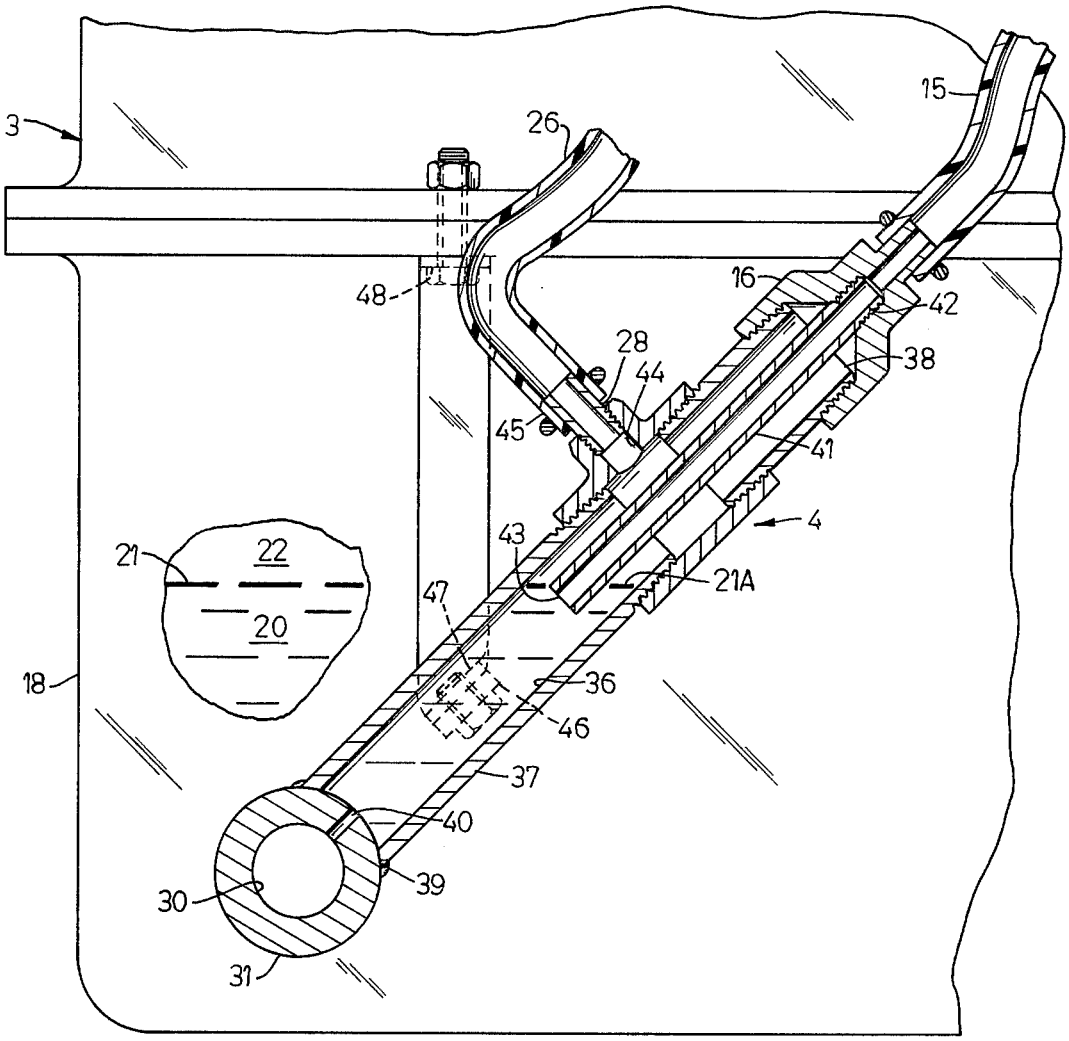
FIG. 3 shows a sectioned view of the standpipe apparatus of FIG. 2, as indicated by convention.

FIG. 3 is a side view of FIG. 2 with apparatus 4 sectioned as indicated by convention.

Apparatus 4 contains a sensing chamber 36 defined by a cylindrical fluid containing member 37 having a first or upper end 38 sealingly engaged with connective means 16 and a second or lower end 39 sealingly engaged with base member 31.

The second or lower end 39 of chamber 36 is in fluid flow communication with oil passage 30 of base member 31 by a liquid flow rate retarding or dampening means, such as orifice 40. The lower end 39 of sensing chamber 36 is located at a level below the desired oil level 21 of oil pool 20 within crankcase 18 and the upper end of chamber 36 is located at a level above the desired oil level 21.

As chamber 36 is in fluid flow communication with crankcase 18 oil in the crankcase will flow into chamber 36 and rise to the level 21A within chamber 36 equal to level 21 within the crankcase. That portion of sensing chamber 36 above oil level 21A will be an air space.

A sensing member, such as conduit 41, serves as an extension of air carrying conduit 15 and has a first end 42 in fluid flow communication with the air space in tank 5 by being sealingly engaged with conduit 15 and a second end 43 which is open and maintained at that level within sensing chamber 36 at which it is desired to maintain oil in the crankcase.

A vent means, such as opening 44, in a wall portion of member 37 above the desired oil level 21A within the sensing chamber 36, is sealingly engaged by appropriate connective means 28 with a second end 45 of vent conduit 26 and thereby places the air space in sensing chamber 36 in fluid flow communication with the air space 22 above oil level 21 in crankcase 18 via the air space present on the interior of rocker arm cover 23, as shown in FIG. 1.

As best shown in FIG. 2, the rigid connection of base member 31 to the wall of crankcase 18 by members 19 and 35 together with position maintenance means, such as bracket 17, which is rigidly attached at a first end 47 to a bracket 46 rigidly secured to a side wall portion of member 37, as by welding, and at a second end 48 to a portion of engine 3 maintains apparatus 4 in a fixed position relative to crankcase 18.

When, as shown in FIGS. 2 and 3, the oil level 21A within sensing chamber 36 covers end 43 of sensing conduit 41 air from the air space in chamber 36 above level 21A is prevented from flowing to the air space in the reservoir and consequently no oil flows into the crankcase via supply line 13, oil flow chamber 30 and the associated connective means. As oil is consumed and oil level 21 in the crankcase and 21A in the sensing chamber are lowered end 43 of sensing conduit 41 will be uncovered and air will flow to the crankcase until end 43 is again covered and sealed by oil and when the pressure differential between the air space in the sensing chamber and the air space in the reservoir equals the head of oil in the supply line oil will cease to flow in the supply line until end 43 is again uncovered.

Having an equal air pressure in the sensing chamber and in the crankcase is important to assure that the desired level of oil is maintained within the crankcase. If the air pressure within chamber 36 is higher than in the crankcase the oil level 21A would tend to be depressed to give a false low oil level indication to the system and excess oil would flow to the crankcase. Conversely, if the air pressure in the sensing chamber 36 is less than in air space 22 the oil level 21A within chamber 36 would tend to be higher than level 21 in crankcase 18 and no oil would flow to the crankcase even though a low oil level was present within the crankcase.

By placing the air space in the sensing chamber and in the crankcase in fluid flow communication with each other by vent means which are not subject to having the venting function impaired by oil flow within the vent means equal pressure in each air space is assured and the sensing chamber air space is also isolated from localized windages or air currents within the crankcase caused by moving components of the engine of from blowby gases which could cause a rapid fluctuation of the air pressure in the air space in the sensing chamber. It is to be understood that vent conduit 26 could be connected to engine 3 at a variety of locations on a particular engine to provide the advantages as taught herein.

Flow orifice 40, as shown in FIG. 3, aids in preventing a rapid rise and fall of the oil level within the sensing chamber by retarding the rate of flow of oil from oil flow chamber or passage 30 into and out of sensing chamber 36. Engines mounted on vehicles are subjected to being oriented at an infinite variety of positions other than level. Depending on the direction of tilt, the oil will either flow into or out of sensing chamber 36. Orifice 40, by being substantially smaller in cross sectional flow area than chamber 36, serves to maintain oil level 21A at a more consistent average level to reduce the effects of oil slosh caused by such tilting.

It is preferable to have each the volume of the sensing chamber 36 and the flow area of flow passage 30 substantially larger than the flow area of orifice 40. For example, in one standpipe embodiment a sensing chamber having a diameter of 9/16 inch is used with a flow orifice 5/32 inch in diameter and a flow passage ⅜ inch in diameter.

The relatively large size of the flow passage permits oil to readily flow into the crankcase from the reservoir and the relatively small orifice, relative to the volume of oil present in chamber 36, provides a slow changing oil level within chamber 36 relative to what the rate of oil level change would be if flow between the sensing chamber and the flow passage were unrestricted. Orifice 40 should be sized to provide a slow rate of oil level change within sensing chamber 36 but it should not be made so small that it is susceptible to plugging by sludge or particulate matter. Having the orifice positioned between the sensing chamber and the path of oil flow to the engine, rather than in the crankcase, such as within fitting 35, protects the orifice from plugging, does not impede or restrict the rate of flow of oil from the reservoir to the crankcase and assures, in conjunction with the venting function of conduit 26, that oil level 21A in the sensing chamber will be substantially equal to, or representative of, oil level 21 in the crankcase.

As shown in FIG. 2, a sensor protection tube 50 is rigidly attached to fitting 35 and projects a substantial distance into oil pool 20. Due to localized air currents or windages within the crankcase 18 caused by moving components, such as the crankshaft 51 (See FIG. 1) and associated components 52 and/or gases which escape past the piston rings 53 in cylinder 54 air may be, under certain conditions, driven downwardly along a portion of the inner surface, such as at 55, with sufficient force to cause it to force air flow to opening 56 of fitting 35. Under such a condition a quantity of air may travel into oil flow chamber 30 and either enter sensing chamber 36 or travel up supply line 13 to tank 5. If such a condition occurs periodically due to a particular mode of engine operation and/or because of a worn or broken piston ring, a substantial amount of air may be introduced to tank 5 and cause an undesirable overfull oil level in crankcase 18.

Therefore, it is preferably to protect opening 56 from such an occurrence by placing tube 50 in opening 56 and having it project into a relatively calm portion of the oil pool whereby any air or oil entering opening 56 must first pass through an open end 57 of tube 50.

Due to the position of end 57 of tube 50 in a relatively calm area of the oil pool which is less susceptible to air current disturbance introduction of air into opening 56 by the above described phenomena is substantially eliminated.

Figure 5:
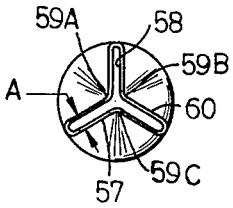
FIG. 5 shows an end view of the protection tube shown in FIG. 4.
Figure 4:
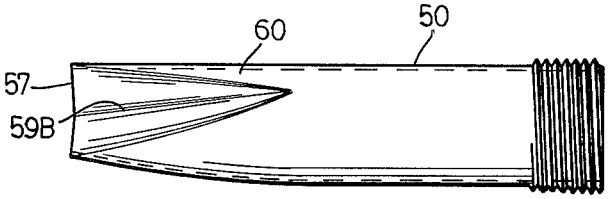
FIG. 4 shows an enlarged side view of a protection tube used to protect the standpipe apparatus shown in FIG. 2.

FIGS. 4 and 5 show protection tube 50 in enlarged detail to illustrate a bubble excluding means provided at end 57 of tube 50. As shown in FIG. 5, end 57 is comprised of a trilobate slot 58 through which oil flows. Slot 58 may be formed by forcing three equally spaced points 59A, 59B and 59C of wall 60 of tube 50 radially inwardly. The slot width, as indicated by conventional dimension line A, is preferably about 0.015 inch but may be made larger or smaller, depending on oil viscosity, normal operation temperature, etc. Trilobate slot 58 serves to resist entry of air or gases present in the oil pool 20 in the form of small bubbles from entering tube 50 and subsequently flowing to the reservoir. Such air or gas bubbles may be driven into or entrained in oil pool 20 by violent air currents caused by the moving components above oil pool 20 or by blowby gases.

What is claimed is:

1. In a gravity induced flow oil level regulator system for automatically maintaining oil at a desired level in the crankcase of an engine, said system having an air tight oil reservoir maintained at a level higher than the desired level at which oil is to be maintained in said crankcase, a standpipe located outside of said crankcase and maintained in a fixed position relative to said crankcase, said standpipe having a sensing chamber having a lower oil containing portion in fluid flow communication with said reservoir and said crankcase and an upper air containing portion sealingly connected in fluid flow communication with an air containing portion of said oil containing reservoir; the improvement comprising:

vent means sealingly engaged with said air containing portion of said sensing chamber and with a substantially oil free air containing space in said engine, said substantially oil free air containing space being in fluid flow communication with an air containing space in said crankcase and remote from said air containing space in said crankcase, said vent means being for providing substantially oil free fluid flow communication between said crankcase and said sensing chamber for assuring that air pressure in said air containing portion of said sensing chamber is substantially equal to air pressure in said crankcase.

2. The invention as defined in claim 1 in which said substantial oil free air containing space is located within a rocker arm cover of said engine.

3. A standpipe type sensing and supply device for a gravity induced flow oil level regulator for maintaining oil at a desired level in the crankcase of an engine, said device comprising:

a first member having a first end and a second end and an oil flow passage extending from said first end to said second end of said first member, said first end being adapted for being sealingly engaged with an oil supply line from an oil reservoir and said second end being adapted for being sealingly engaged with an engine crankcase at a level below the level at which it is desired to maintain oil within said crankcase for enabling oil to flow from said reservoir to said crankcase through said oil passage in said first member;

a second member having a first end and a second end and a sensing chamber extending between said first end and said second end of said second member, said second end of said second member being sealingly engaged with said first member;

means for providing fluid flow communication between said oil passage of said first member and said sensing chamber of said second member;

a sensing conduit extending through said first end of said second member, said sensing conduit having a first end adapted for being sealingly engaged in fluid flow communication with an air space in said oil reservoir and a second open end adapted for being positioned within said sensing chamber between said first end and said second end of said second member at a point which corresponds to a level within said crankcase at which it is desired to maintain oil in said crankcase;

means adjacent said first end of said second member for effecting a seal between said first end of said second member and said sensing conduit; and air carrying vent means having a first end sealingly engaged in fluid flow communication with that portion of said sensing chamber between said first end of said second member and said open end of said sensing conduit and a second end adapted for being sealingly engaged with a substantially oil free air containing space in said engine, said substantially oil free air containing space being in fluid flow communication with an air space above the desired oil level in said crankcase for providing substantially unimpeded air flow between said crankcase and said sensing chamber during operation of an engine.

4. The invention as defined in claim 3 in which said means for providing fluid flow communication between said oil passage of said first member and said sensing chamber of said second member is comprised of a fluid flow orifice having a cross sectional fluid flow area substantially smaller than a cross sectional fluid flow area of said sensing chamber for retarding the rate of oil flow to and from said sensing chamber.

5. The invention as defined in claim 3 in which said second end of said vent means is adapted for being sealingly engaged with an air space contained within a rocker arm cover of an engine.

6. In a gravity induced flow oil level regulator system for automatically maintaining oil at a desired level in an engine crankcase, said system having an air tight reservoir maintained at a level higher than the desired level at which oil is to be maintained in said crankcase, a standpipe located outside of said crankcase and maintained in a fixed position relative to said crankcase, said standpipe having a sensing chamber having a lower oil containing portion in fluid flow communication with each said reservoir and said crankcase and an upper air containing portion, said upper air containing portion having a sensing conduit in fluid flow communication with an air space in said reservoir and vent means for enabling air to enter and exit said air containing portion of said sensing chamber, the improvement comprising:

a liquid flow rate dampening means interposed between said oil containing portion of said sensing chamber and said crankcase and said reservoir whereby oil may flow from said reservoir to said crankcase without flowing through said liquid flow rate dampening means and said flow rate dampening means retards the rate of oil flow into and out of said sensing chamber.

7. The invention as defined in claim 6 in which said liquid flow rate dampening means is an orifice substantially smaller in cross sectional area than the cross sectional area of said sensing chamber.

8. The invention as defined in claim 7 in which a member having an oil flow passage in fluid flow communication with each said reservoir and said crankcase is sealingly engaged with a lower portion of said oil containing portion of said sensing chamber and said orifice is placed in a wall of said member for providing fluid flow communication between said sensing chamber and said oil flow passage.

* * * * *

UNITED STATES PATENT OFFICE
CERTIFICATE OF CORRECTION

PATENT NO. : 4,091,895
DATED : May 30, 1978
INVENTOR(S) : James R. Lang

It is certified that error appears in the above-identified patent and that said Letters Patent are hereby corrected as shown below:

Column 4, line 37, delete "air" and replace with -- oil --.

Signed and Sealed this

*Twenty-sixth* Day of *May 1981*

[SEAL]

*Attest:*

RENE D. TEGTMEYER

*Attesting Officer*

*Acting Commissioner of Patents and Trademarks*